US005778903A

United States Patent [19]

Tran et al.

[11] Patent Number: 5,778,903

[45] Date of Patent: Jul. 14, 1998

[54] ACRYLIC CUTTER

[76] Inventors: Thanh-Ha T. Tran, 32271 Mill Stream Rd., Trabuco Canyon, Calif. 92679; Leigh Ann Peterson, 21976 Kingshill, Mission Viejo, Calif. 92692

[21] Appl. No.: 784,126

[22] Filed: Jan. 15, 1997

[51] Int. Cl.[6] ..... A45D 29/00

[52] U.S. Cl. ..... 132/200; 30/26

[58] Field of Search ..... 30/26, 27, 113.1, 30/164.9, 315, 346.55; 132/73, 75.4, 285, 200

[56] References Cited

U.S. PATENT DOCUMENTS

| | | | |
|---|---|---|---|
| 376,136 | 1/1888 | Burrowes | 30/315 |
| 606,937 | 7/1898 | Pancoast . | |
| 959,450 | 5/1910 | Bridgeman | 30/113.1 |
| 1,712,405 | 4/1929 | Sapo . | |
| 2,055,357 | 9/1936 | Konecke | 132/73 |
| 2,094,962 | 10/1937 | Raworth | 132/73 |
| 2,220,758 | 11/1940 | Florio | 132/73 |
| 2,234,657 | 3/1941 | Smaldeon | 132/73 |
| 3,258,018 | 6/1966 | Tinsley | 132/88.5 |
| 3,382,878 | 5/1968 | Dinerstein | 132/88.5 |
| 4,577,648 | 3/1986 | Dinerstein et al. | 132/73 |
| 4,960,587 | 10/1990 | Rucker | 424/61 |
| 5,044,384 | 9/1991 | Hokama et al. | 132/200 |
| 5,398,704 | 3/1995 | Dombeck | 132/285 |

FOREIGN PATENT DOCUMENTS

| | | | |
|---|---|---|---|
| 2105188 | 3/1983 | United Kingdom | 132/73 |

*Primary Examiner*—Douglas D. Watts
*Attorney, Agent, or Firm*—Goldstein & Associates

[57] ABSTRACT

An acrylic cutter, having a distinct proximal segment used as a handle and a distinct distal segment having a flat top portion and a concave bottom portion. A channel recessed through the mid-section of the top portion of the distal segment produces a thin sharp edge. When said edge is pressed onto the tip of an acrylic fingernail, the impression of a perfect curved line is created on the acrylic nail, thus providing a guideline for creating a flawless french manicure look or similar design using acrylic on the nail.

2 Claims, 2 Drawing Sheets

ACRYLIC CUTTER

BACKGROUND OF THE INVENTION

The invention relates to an acrylic cutter. More particularly, the invention relates to an acrylic cutter that impresses a perfect curved line on acrylic nails to aid in the application of pink and white acrylics to achieve the look of a french manicures without using nail polish.

French manicures are perhaps the most popular nail design that women elect for all occasions—from everyday wear to weddings. This design consists of a white crescent coat of acrylic on the tip of the fingernail, followed by an overlay, usually pink or creme, coating the entire fingernail. The combination of colors gives the fingernails a natural look.

In order to enhance the beauty of a french manicure, it has become very popular to apply acrylic nails over one's natural nails. Besides strengthening the nail, the acrylic nails often add length to one's natural nails. Many women who are forced to work with their hands find it difficult to keep their nails at a desired length. Often one nail will break, necessitating the cutting of the rest of the nails. Acrylic nails give women the ability to work with her hands while keeping long nails.

The customary means of applying pink and white acrylics consist of drawing a curved line with a brush or a nail tip dipped in acetone and then applying pressure on the acrylic nail in order to outline a perfect curved line. Such a procedure requires considerable skill and a steady hand in order to achieve a perfect nail. Trying to make a perfect line using one's hand often results in a crooked or uneven line. Because of the difficulty of drawing a perfect curved line, many acrylics are often ruined, making it necessary to reapply acrylic over the whole nail.

While these methods and devices may be suitable for the particular purpose employed, or for general use, they would not be as suitable for the purposes of the present invention as disclosed hereafter.

SUMMARY OF THE INVENTION

It is an object of the invention to produce an acrylic cutter for impressing a perfect curved line in acrylic nails for applying pink and white acrylics or similar design to one's nails.

It is another object of the invention to produce an acrylic cutter with an edge in the shape of a curved line. When pressed upon an acrylic nail, the acrylic cutter creates an impression of a perfect curved line into the acrylic.

It is a further object of the invention to produce an acrylic cutter that eliminates the possibility of crooked or uneven curved lines when applying pink and white acrylics to achieve a look of a french manicure without the polish. The pre-shaped edge of said cutter creates even, uniform curves on all the nails.

The invention is an acrylic cutter, having a distinct proximal segment used as a handle and a distinct distal segment having a flat top portion and a concave bottom portion. A channel recessed through the mid-section of the top portion of the distal segment produces a thin sharp edge. When said edge is pressed onto the tip of an acrylic nail, the impression of a perfect curved line is created on the nail, thus forming the look of a flawless french manicure or similar design on the nail.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 5:
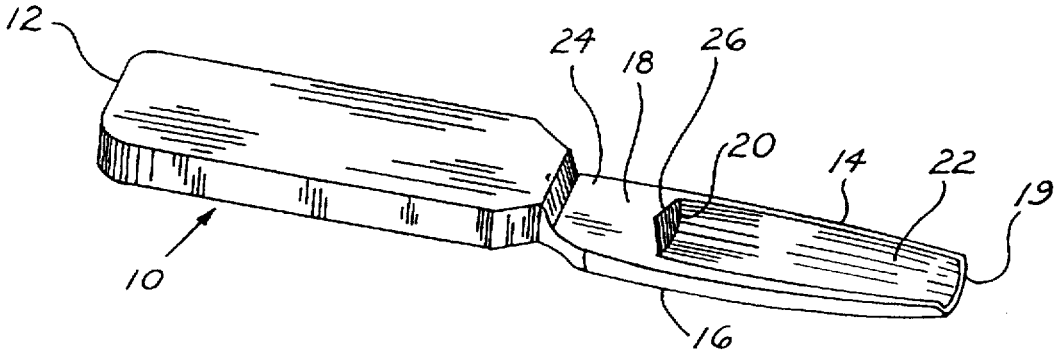
FIG. 5 is a diagrammatic perspective view of an acrylic cutter.

FIG. 5 illustrates an acrylic cutter 10, having a distinct proximal segment 12 and a distinct distal segment 14. The proximal segment 12 is used as a handle when working with the cutter 10.

The distal segment 14 of the acrylic cutter 10 has a bottom portion 16, a top portion 18 and an impression edge 19 at the most distal point. The top portion 18 comprises a flat belly 24 and the bottom portion 16 is concave. The bottom portion 16 extends the entire length of the distal segment 14 while a mid-section 26 of the top portion 18 ends at a mid-point 20 of the distal segment 14. A channel 22, recessed through the mid-section 26 of the belly 24 of the top portion 18, extends from the edge 19 to the mid-point 20 of the distal segment 14. The edge 19 of the distal segment 14 is created by the concave shape of the bottom portion 16. The acrylic cutter 10 is made in several different sizes to accommodate the varying sizes of one's fingernails.

Figure 1:
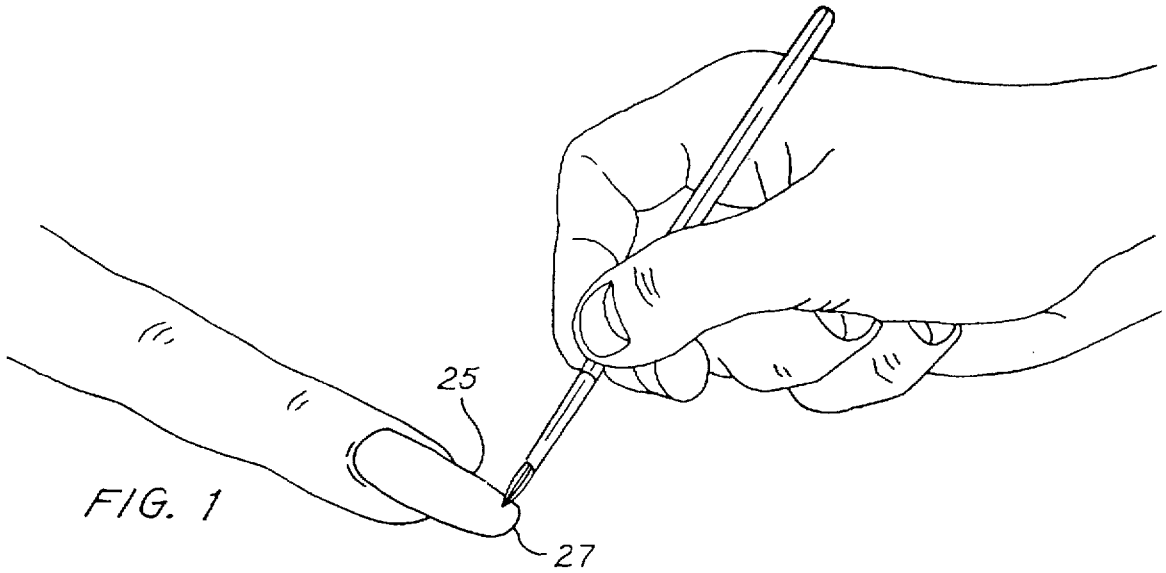
FIG. 1 is a diagrammatic perspective view of fingernail with white acrylic being applied to the tip.
Figure 2:
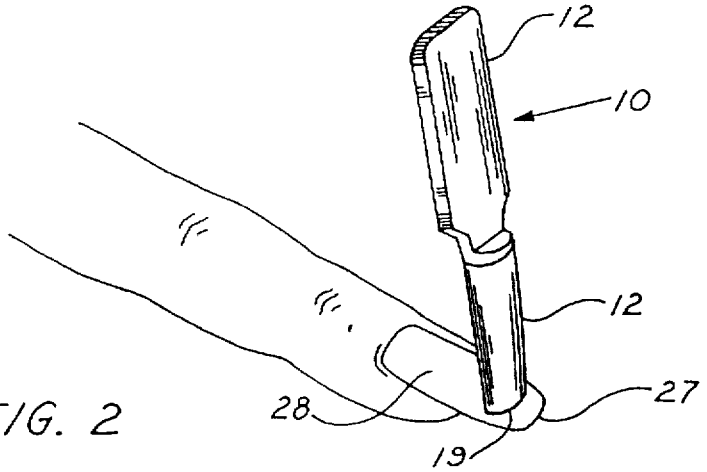
FIG. 2 is a diagrammatic perspective view of an acrylic cutter impressing a curved line on the tip of the fingernail.
Figure 3:
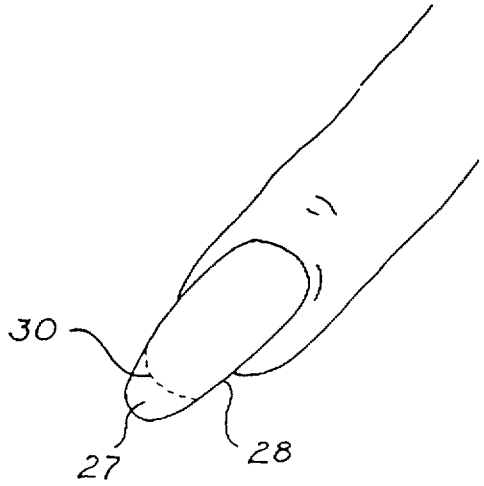
FIG. 3 is top plan view of a fingernail with a curved line impressed in the acrylic shown in dotted lines.
Figure 4:
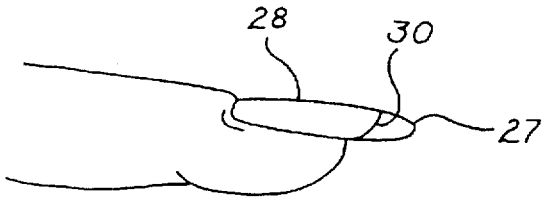
FIG. 4 is a right side view of a fingernail with a curved line impressed in the acrylic.

As illustrated in FIG. 1, the application of a french manicure look or similar style of acrylic typically commences with applying white acrylic to a tip 27 of a fingernail 28. Referring to the FIG. 2, the acrylic cutter 10 is then used to impress a perfect curved line 30 on the tip 27 of the acrylic nail 28 by bringing the impression edge 19 to the surface of the fingernail 28 at substantially a right angle. The perfect curved line divides the nail into an inner portion and an outer portion. An overlay coat of pink or creme acrylic is then applied to the entire nail 28, thus creating the well-known look of a french manicure, as best illustrated in FIGS. 3 and 4. A further step can then be taken of coating the nail with clear nail polish.

Referring back to FIG. 2, in creating the curved line 30 at the tip 27 of the nail 28, the acrylic cutter 10 is held by the proximal segment 12 and pressed at substantially a right angle against the tip 27 of the nail 28, therefore causing the edge 19 to impress a curved line 30 into said tip 27 and divide the nail into the inner portion and outer portion.

What is claimed is:

1. An acrylic cutter method for use in the application of an acrylic fingernail to achieve the look of a french manicure without using nail polish, comprising the steps of:

applying a coat of acrylic to a tip of a fingernail;

holding the acrylic cutter by the proximal segment and positioning said cutter at the tip of the acrylic fingernail, thereby causing the edge of the distal segment to contact said tip; and impressing a curved line on the tip of the acrylic nail to divide the nail into an inner portion and an outer portion by applying pressure to the acrylic cutter;

applying a second coat of acrylic to the entire acrylic nail, thereby creating a french manicure look.

2. The acrylic cutter method as recited in claim 1, wherein the recited steps are followed by the step of:

coating the entire nail with clear nail polish.

* * * * *